US009580993B2

(12) United States Patent
Aitken

(10) Patent No.: US 9,580,993 B2
(45) Date of Patent: Feb. 28, 2017

(54) INTERVENTIONLESS DOWNHOLE SCREEN AND METHOD OF ACTUATION

(71) Applicant: Halliburton Energy Services Inc., Houston, TX (US)

(72) Inventor: Liam Andrew Aitken, Grapevine, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 150 days.

(21) Appl. No.: 14/394,451

(22) PCT Filed: May 10, 2013

(86) PCT No.: PCT/US2013/040539
§ 371 (c)(1),
(2) Date: Oct. 14, 2014

(87) PCT Pub. No.: WO2014/182311
PCT Pub. Date: Nov. 13, 2014

(65) Prior Publication Data

US 2016/0003002 A1 Jan. 7, 2016

(51) Int. Cl.
*E21B 34/10* (2006.01)
*E21B 34/12* (2006.01)
(Continued)

(52) U.S. Cl.
CPC ..... *E21B 34/12* (2013.01); *E21B 34/10* (2013.01); *E21B 34/102* (2013.01); *E21B 43/08* (2013.01);
(Continued)

(58) Field of Classification Search
CPC ..... E21B 34/10; E21B 34/102; E21B 34/12; E21B 2034/007; E21B 43/08; E21B 43/084; E21B 43/10
See application file for complete search history.

(56) References Cited

U.S. PATENT DOCUMENTS 4,944,349 A * 7/1990 Von Gonten, Jr. ..... E21B 37/00 166/304
6,220,357 B1 * 4/2001 Carmichael ..... E21B 34/10 166/227

(Continued)

OTHER PUBLICATIONS

Search Report and Written Opinion of the International Searching Authority, or the Declaration; Feb. 17, 2014; 13 pages; Korean International Searching Authority, Korean Intellectual Property Office, Republic of Korea.

*Primary Examiner* — Matthew R Buck
(74) *Attorney, Agent, or Firm* — Haynes and Boone LLP

(57) ABSTRACT

An interventionless downhole screen that is resistant to plugging during run-in-hole operations and a method for remotely actuating the screen. The screen includes a perforated sleeve that is slideably disposed coaxially with a perforated tubular member. When running, the sleeve is in a closed positioned with its openings offset from the apertures in the tubular member, thereby blocking flow through the screened openings, while a check valve through the tubular member allows fluid ingress. To actuate for production, the tubular member is pressurized, which moves a piston into ratcheting engagement with the sleeve. A subsequent depressurization allows the piston to return to its original position, carrying with it the sleeve to an open position where the sleeve and tubing perforations are aligned for allowing fluid flow into the tubular member.

16 Claims, 5 Drawing Sheets

(51) Int. Cl.

| | |
|---|---|
| ***B21B 43/08*** | (2006.01) |
| ***E21B 43/10*** | (2006.01) |
| ***E21B 43/08*** | (2006.01) |
| *E21B 34/00* | (2006.01) |

(52) U.S. Cl.
CPC ..... *E21B 43/084* (2013.01); *E21B 2034/007* (2013.01)

(56) References Cited

U.S. PATENT DOCUMENTS

| | | | | |
|---|---|---|---|---|
| 7,296,633 | B2 * | 11/2007 | Bode et al. | E21B 34/08 166/334.1 |
| 8,127,831 | B2 | 3/2012 | Haeberle et al. | |
| 2003/0141060 | A1 | 7/2003 | Hailey, Jr. et al. | |
| 2004/0035578 | A1 * | 2/2004 | Ross | E21B 43/08 166/250.15 |
| 2004/0035591 | A1 * | 2/2004 | Echols | E21B 43/08 166/386 |
| 2004/0149435 | A1 * | 8/2004 | Henderson | E21B 34/14 166/250.15 |
| 2009/0008092 | A1 | 1/2009 | Haeberle et al. | |
| 2009/0032255 | A1 * | 2/2009 | Surjaatmadja | E21B 33/13 166/281 |
| 2009/0133869 | A1 * | 5/2009 | Clem | E21B 23/04 166/250.15 |
| 2014/0318811 | A1 * | 10/2014 | O'Brien | E21B 43/08 166/381 |

* cited by examiner

INTERVENTIONLESS DOWNHOLE SCREEN AND METHOD OF ACTUATION

CROSS REFERENCE TO RELATED APPLICATIONS

The present application is a U.S. National Stage patent application of International Patent Application No. PCT/US2013/040539, filed on May 10, 2013, the benefit of which is claimed and the disclosure of which is incorporated herein by reference in its entirety.

BACKGROUND

1. Technical Field

The present disclosure relates generally to completing and producing oil and gas wells, and specifically to a novel method and system for deploying a downhole screen.

2. Background Art

In the process of completing on oil or gas well, a tubular is run into the hole through which produced fluids will be communicated to the surface. Typically, this tubular includes a screen assembly that filters gravel, sand, and other particulate matter from entering the tubular.

When running this completion string into the well, the well may contain drilling mud, brine, or other fluid. Further, this fluid may be laden with rock, cutting chips, sand, and the like. Fluid tends to enter the empty tubular through the screen assembly, and such particulate can substantially plug the screen assembly by the time it has been lowered into the desired position.

Accordingly, it is desirable to provide a screen assembly that resists plugging during run-in-hole operations.

BRIEF DESCRIPTION OF THE DRAWINGS

The invention is described in detail hereinafter on the basis of the embodiments represented in the accompanying figures, in which.

DETAILED DESCRIPTION

Figure 1:
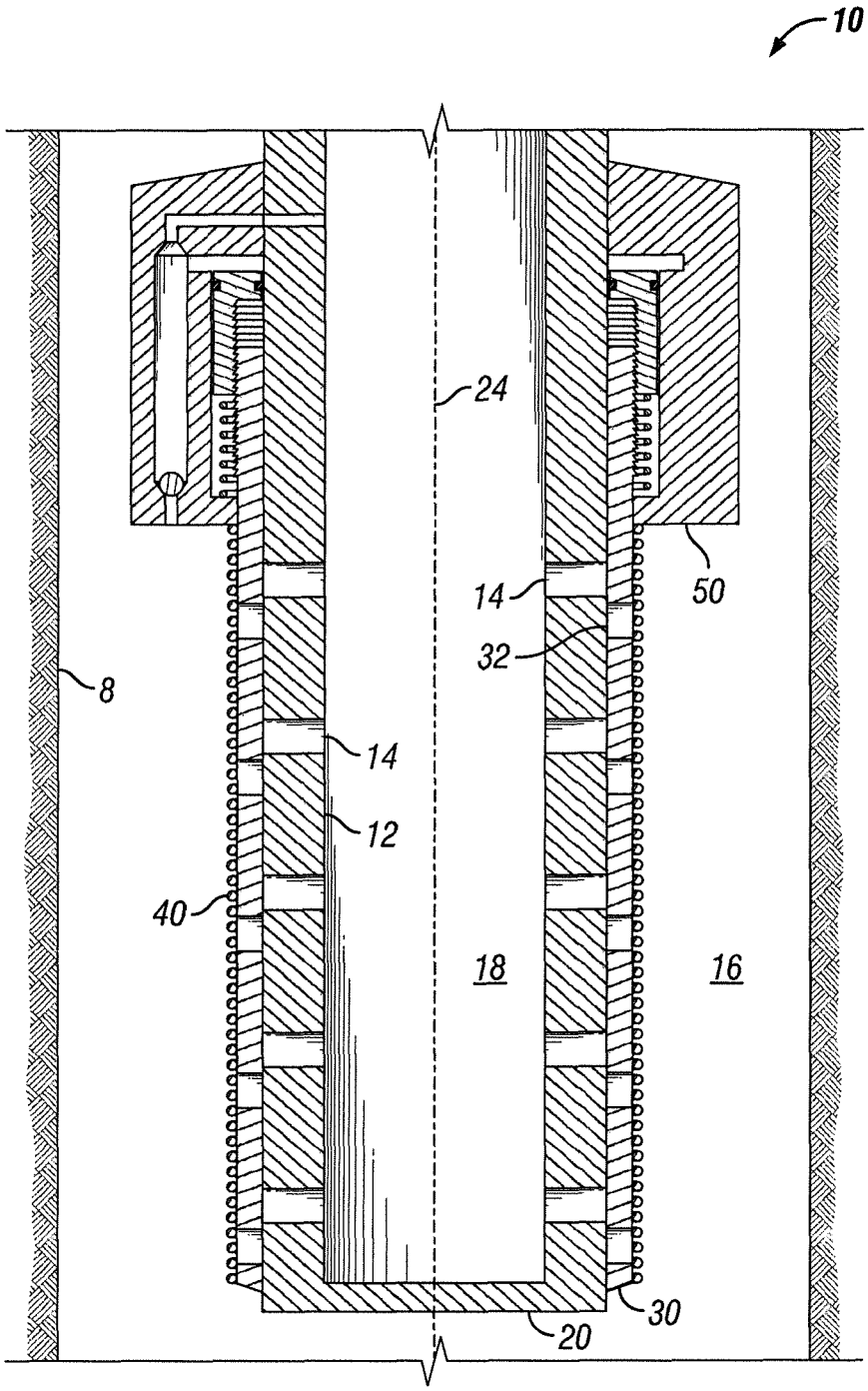
FIG. 1 is a longitudinal cross section of a downhole screen assembly according to a present embodiment, showing a tubular member with apertures formed through the wall, a sleeve slideably disposed about the tubular member with openings that correspond to the apertures, and an actuator that remotely moves the sleeve with respect to the tubular member.

FIG. 1 is a longitudinal cross section of a downhole screen assembly 10 for use within a well 8 according to a present embodiment. Screen assembly 10 includes a tubular member 12, which may be cylindrical in shape. However, other tubing shapes, such as square tubing, may be used as appropriate. Tubular member 12 includes a plurality of apertures 14 for the intake of well fluids from an exterior or annular region 16 to the interior 18 during well production. Tubular member 12 may have a closed lower end 20 for terminating the bottom of the tubing string in the well. If multiple screen assemblies 10 are provided in a tubing string, only the lowest screen assembly would have a closed lower end.

According to an embodiment, screen assembly 10 includes a sleeve 30 having the same shape type as tubular member 12, which preferably abuts but can be moved relative to tubular member 12. Sleeve 30 is shown disposed about the exterior wall surface of tubular member 12, but in an alternative arrangement (not illustrated), the tubular member could be disposed about the sleeve. Sleeve 30 includes a plurality of openings 32, which correspond to apertures 14. Sleeve 30 may have a closed lower end (not illustrated) if it is the last device in tubing string.

FIG. 1 shows sleeve 30 in a shut position where openings 32 are offset from apertures 14 to prevent fluid flow therebetween. In the embodiment illustrated, sleeve 30 can slide longitudinally along axis 24 with respect to tubular member 12, and openings 32 are radially aligned with longitudinally offset from apertures 14. However, in other embodiments (not illustrated), openings 32 may be radially offset instead of or in addition to longitudinally offset, and sleeve 30 is capable of rotating with respect to tubular member 12.

Screen assembly includes a mesh, screen or filter 40 disposed so as to prevent sand, sediment, gravel, and other particulate matter of predetermined size from entering into the interior 18 of tubular member 12. FIG. 1 shows mesh 40 to be disposed about the exterior of sleeve 30, but meshing 40 can be disposed within tubular member 12, within apertures 14, between tubular member and screen 30, within openings 32, or any combination of the above as would be known to one of ordinary skill in the art.

A actuator 50 is operatively connected between tubular member 12 and sleeve 30 which provides for remote, interventionless actuation from the surface of screen assembly 10 to move screen 30 with respect to tubular member 12 so that openings 32 align with aperture 14 to allow fluid flow into the interior 18. In this manner, downhole screen assembly 10 can be run into a well 8 with sleeve 30 in a shut position, thereby preventing fluid flow into the screen assembly and minimizing the tendency for particulate matter to plug mesh 40. Once screen assembly 10 has been lowered to the desired position within well 8, sleeve 30 may be actuated to an open position to allow well production simply by pressurizing interior 18, as is described below with respect to FIGS. 2-5.

Although actuator 50 is shown in FIG. 1 as being located at the top of sleeve 30, it may also be located the bottom or somewhere in the middle of sleeve 30.

Figure 2:
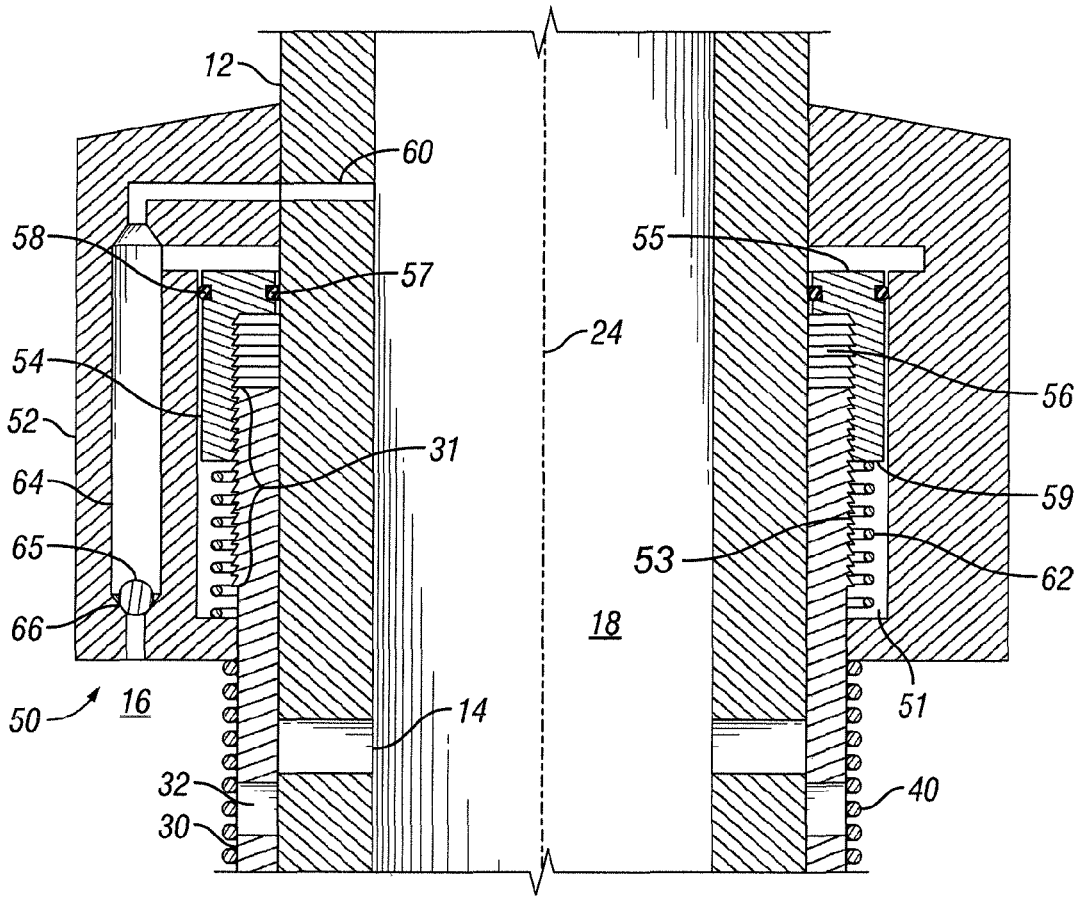
FIG. 2 is an enlarged longitudinal cross section of the downhole screen of FIG. 1, showing detail of the actuator as actuation of the screen is first begun.

FIG. 2 is an enlarged longitudinal cross section of the downhole screen of FIG. 1, showing detail of actuator 50. In a particular embodiment, actuator 50 includes a housing 52 with an inner cylindrical chamber 51, through which tubular member 12 passes and in which a portion 31 of sleeve 30 is located. Sleeve portion 31 includes ratchet teeth 53. A body lock ring 54 is provided within housing 52, and it also includes ratchet teeth 56 that engage ratchet teeth 53 so as to allow axial movement of the body lock ring 54 with respect to sleeve portion 31 in one direction only as described in further detail below.

Body lock ring 54 is axially movable about tubular member 12 within chamber 51. A first end 55 of body lock ring 54 acts as an annular piston face and is in fluid communication with the interior 18 of tubular member 12 via a conduit 60. Body lock ring 54 includes inner and outer dynamic seals 57, 58, for example grooves with seated o-rings, that seal against an outer wall section of tubular member 14 and in the inner wall of chamber 51 within housing 52, respectively, yet allow relative movement of body lock ring 54. The second end 59 of body lock ring 54 rests against a resilient member 62, such as a coiled spring, which resists an increase of pressure acting on piston face 55.

Conduit 60 also includes a check valve 64 that selectively connects the interior 18 to the exterior 16. As illustrated, check valve 64 may include a ball 65 and a seat 66, whereby the ball 65 is forced and seals against the seat 66 when the fluid pressure within the interior 18 is pressurized with respect to the pressure of the exterior 16. When the pressure gradient is reversed, ball 65 lifts off of seat 66 and allows flow. Accordingly, when screen assembly is being run into the well, as shown in FIG. 1, well fluid can enter tubular member 12 through check valve 64 and conduit 60, rather than through apertures 12 to reduce the risk of plugging the screen assembly. Although only one check valve 64 is illustrated, multiple check valves may be used as appropriate.

FIG. 2 depicts screen actuator 50 after the screen assembly has been run into the well and at the initial point in the actuation sequence where the interior fluid pressure has been raised to shut check valve 64, thereby allowing the tubular member 14 to be pressurized at the surface, with a concomitant increase in pressure acting at piston face 55 of body lock ring 54.

Figure 3:
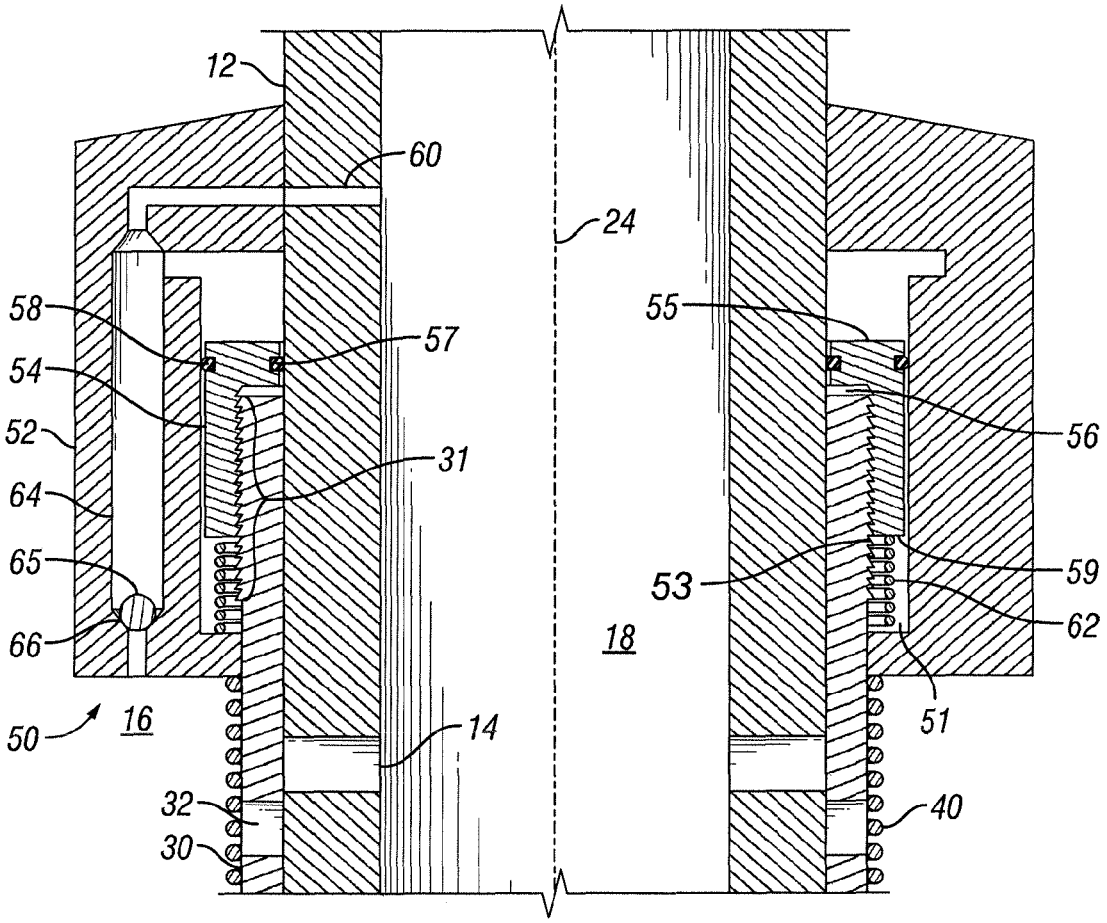
FIG. 3 is an enlarged longitudinal cross section of the actuator of FIG. 2, showing the body lock ring having been displaced and further engaged the sleeve under the influence of a pressurized interior.

Referring now to FIG. 3, further increasing fluid pressure within interior 18 causes a greater force to be exerted on piston face 55 of body lock ring 54, thereby compressing resilient member 62 and moving body lock ring 54 toward sleeve 30. As body lock ring 54 moves toward sleeve 30, ratchet teeth 56 are forced past and engage ratchet teeth 53, as explained in greater detail below with reference to FIG. 4.

Figure 4:
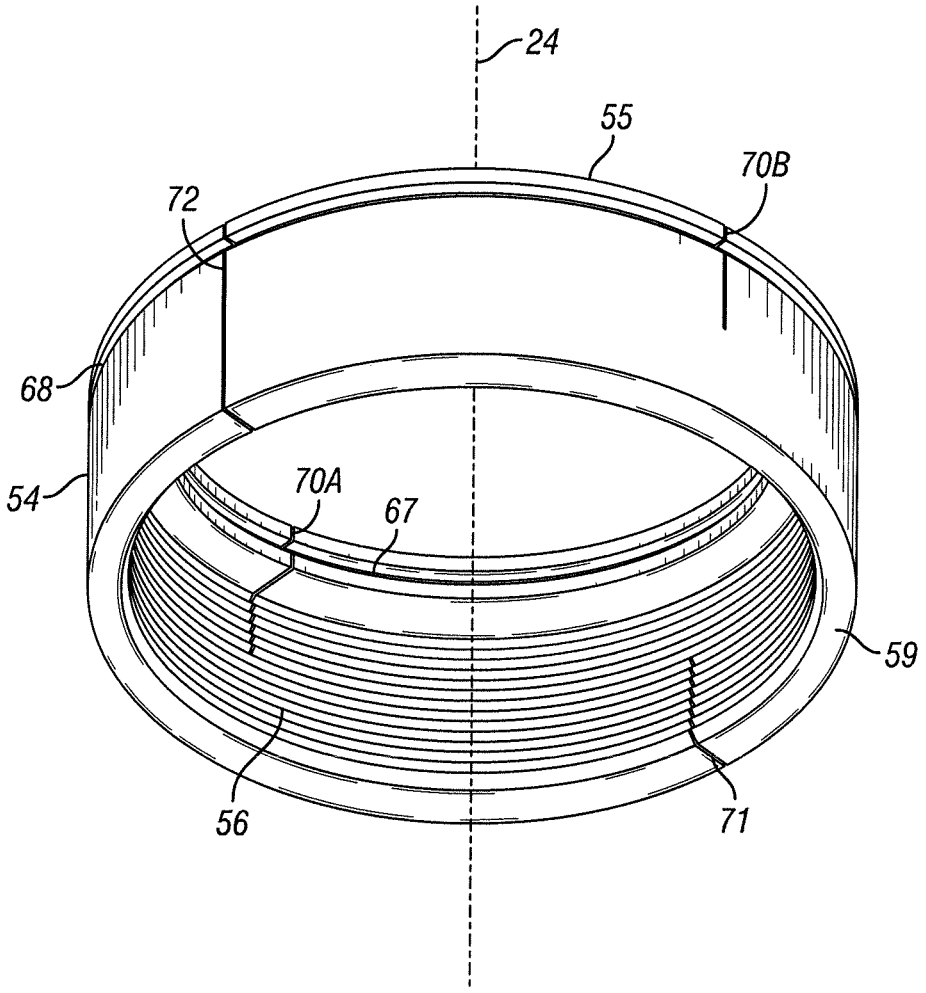
FIG. 4 is a perspective view of the body lock ring of the actuator of FIG. 3, showing an interior wall surface having ratchet teeth for unidirectional movement against ratcheting teeth of the slideable sleeve of FIG. 3.
Figure 5:
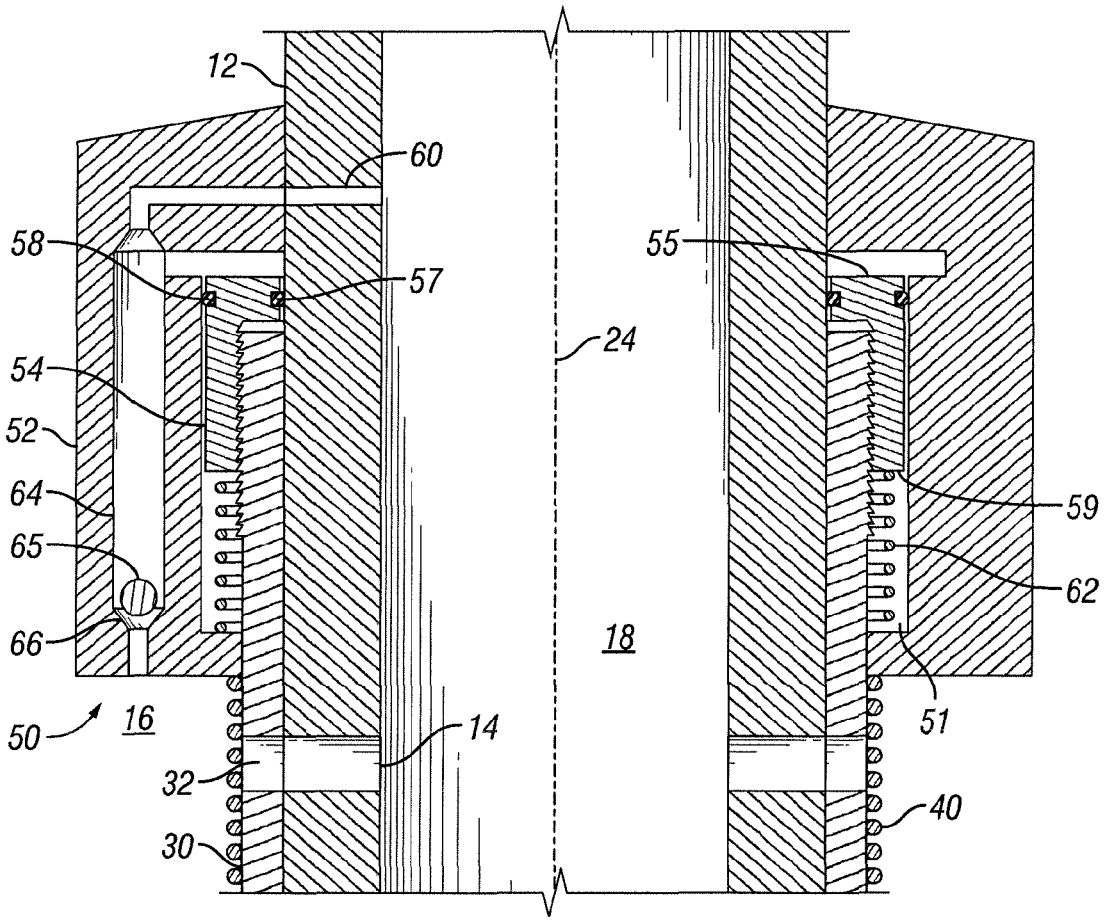
FIG. 5 is an enlarged longitudinal cross section of the actuator of FIG. 3, showing the sleeve moved to the open position after remote actuation.

FIG. 4 is a perspective view of body lock ring 54 according to a particular embodiment. The first end 55 has a smaller internal diameter than the second end 59. Near the first end 55, a circumferential groove 68 is provided around the exterior wall surface into which dynamic seal 58 is seated for sealing against the wall of chamber 51 in housing 52 (FIG. 3). Similarly, a circumferential groove 67 is provided around the inner wall surface into which dynamic seal 57 is seated for sealing against the outer wall section of tubular member 12 (FIG. 3). Body lock ring 54 includes a section having ratchet tooth profile 56. In particular, and as best seen in FIG. 3, a typical ratchet tooth profile is similar to a buttress thread; one side of each tooth is perpendicular to the longitudinal axis 24 (as in a square tooth), while the obverse side of each tooth is sloped (as in a 'V' tooth).

Preferably, body lock ring 54 includes a number of slots formed therein to provide a limited resilience to allow body lock ring to elastically deform in a radial direction. As the 'V' sides of ratchet teeth 56 slide against the 'V' sides of ratchet teeth 53 (FIG. 3), an outward radial force is created that temporarily deforms body lock ring 54, thereby allowing the teeth to pass each other. However, when the square sides of ratchet teeth 56 engage the square sides of ratchet teeth 53, no radial force is exerted on body lock ring 54, and no axial motion is permitted. In this manner, body lock ring 54 is capable only of unidirectional motion with respect to portion 31 of sleeve 30 (FIG. 3).

As illustrated, four slots are provided. Two partial slots 70A, 70B are formed halfway through body lock ring 54 at first end 55, one partial slot 71 is formed halfway through body lock ring 54 at second end 59, and one slot 72 is a full slot formed through the entire ring. However, other numbers and combinations of slots and half slots, or other materials, mechanisms, or techniques may be used as appropriate to obtain a ratcheting effect or unidirectional motion. Additionally, body lock ring 54 is described and illustrated as having a ratchet tooth profile 56 on its inner diameter to engage a ratchet tooth profile 53 on the outer diameter of sleeve portion 31, a body lock ring with ratchet teeth on its outer diameter may be used as appropriate.

Returning back to FIG. 3, body lock ring 54 is nearly fully engaged with sleeve 30 due to the pressurization of the interior 18 of tubular member 12. Now referring to FIG. 5, the interior 18 is depressurized. Resilient member 62 forces body lock ring 54 back into its original position, and because of the unidirectional ratchet threads 56, 53, sleeve 30 is axially moved along with body lock ring 54 into an open position. Openings 32 are now aligned with apertures 14 to allow well production.

Although screen assembly 10 is described herein predominately with respect to a single unit, multiple screen assemblies may be used within a single tubing string. Pressurizing the tubing string works to actuate every body lock ring in the string, and subsequently releasing the internal pressure opens every screen in the completion at once.

The Abstract of the disclosure is solely for providing the United States Patent and Trademark Office and the public at large with a way by which to determine quickly from a cursory reading the nature and gist of technical disclosure, and it represents solely a preferred embodiment and is not indicative of the nature of the invention as a whole. The design of screen assembly 10 as described herein also allows the screen gauge to be remotely adjusted by cycling or adjusting the internal pressure so as to clear the screen or increase production, for example.

While various embodiments have been illustrated in detail, the disclosure is not limited to the embodiments shown. It is apparent that modifications and adaptations of the above embodiments may occur to those skilled in the art. Such modifications and adaptations are in the spirit and scope of the disclosure.

What is claimed is:

1. A downhole tool comprising:

a tubular member with a wall defining an interior and an exterior, said wall having an aperture formed therethrough;

a sleeve coaxially disposed so as to abut and be in sliding engagement with said tubular member, said sleeve having a wall with an opening formed therethrough; and an actuator coupled between said tubular member and said sleeve and arranged to move said sleeve with respect to said tubular member from a shut position where said opening is offset from said aperture thereby substantially restricting fluid communication between said opening and said aperture and an open position where said opening and said aperture are aligned so as to permit fluid communication therebetween;

wherein the wall of said sleeve includes a portion with a ratchet tooth profile; and wherein the actuator includes a body lock ring defining first and second ends and having a wall with said ratchet tooth profile that engages said portion of said sleeve so as to allow unidirectional movement of said body lock ring with respect to said sleeve.

2. The downhole tool of claim 1 further comprising:

a mesh disposed so as to filter flow from said exterior to said interior through said aperture.

3. The downhole tool of claim 1 wherein:

in said shut position, said opening is radially aligned with but axially offset from said aperture.

4. The downhole tool of claim 1 wherein:

said sleeve is disposed about the exterior of said tubular member.

5. The downhole tool of claim 1 wherein:

said actuator is fluidly coupled to said interior of said tubular member and is arranged to move said sleeve with respect to said tubular member in response to a change of a fluid pressure within said interior.

6. The downhole tool of claim 5 wherein:

said actuator includes a resilient member that urges said sleeve into said open position against said fluid pressure.

7. The downhole tool of claim 6 wherein:

said resilient member acts upon said first end of said body lock ring; and said fluid pressure acts upon said second end of said body lock ring; whereby a first pressurization of said interior forces said body lock ring to ratchet with respect to said sleeve against said resilient member; and a subsequent depressurization of said interior allows said resilient member to move said body lock ring and thereby move said sleeve from said shut position to said open position.

8. The downhole tool of claim 7 wherein:

said body lock ring is arranged for unidirectional axial movement.

9. The downhole tool of claim 5 further comprising:

a fluid conduit coupled between said interior, said exterior, and said actuator; and a check valve disposed in said conduit between said exterior at a first port and said interior and said actuator at a second port; whereby pressurization of said interior with respect to said exterior shuts said check valve thereby allowing pressurization of said actuator.

10. A method for actuating a downhole screen comprising:

providing a tubular member with a wall defining an interior and an exterior, said wall having an aperture formed therethrough, and a mesh disposed so as to filter flow from said exterior to said interior through said aperture;

disposing a sleeve so as to abut and be in sliding coaxially engagement with said tubular member, said sleeve having a wall with an opening formed therethrough;

moving said sleeve with respect to said tubular member from a shut position where said opening is offset from said aperture thereby substantially restricting fluid communication between said opening and said aperture and an open position where said opening and said aperture are aligned so as to permit fluid communication therebetween;

providing an actuator between said tubular member and said sleeve that is arranged to move said sleeve with respect to said tubular member from said shut position to said open position;

fluidly coupling said actuator to said interior of said tubular member, said actuator arranged so as to move said sleeve with respect to said tubular member in response to a change of a fluid pressure within said interior; and actuating said actuator by changing said fluid pressure;

wherein the wall of said sleeve includes a portion with a ratchet tooth profile; and wherein the actuator includes a body lock ring defining first and second ends and having a wall with said ratchet tooth profile that engages said portion of said sleeve so as to allow unidirectional movement of said body lock ring with respect to said sleeve.

11. The method of claim 10 further comprising:

disposing said sleeve about the exterior of said tubular member.

12. The method of claim 10 wherein:

said actuator includes a resilient member that urges said sleeve into said open position against said fluid pressure.

13. The method of claim 12 wherein:

said resilient member acts upon said first end of said body lock ring; and said fluid pressure acts upon said second end of said body lock ring.

14. The method of claim 13 further comprising:

pressurizing said interior so as to force said body lock ring to ratchet with respect to said sleeve against said resilient member; and then depressurizing said interior so as to allow said resilient member to move said body lock ring and therewith move said sleeve from said shut position to said open position.

15. The method of claim 14 wherein:

said body lock ring is arranged for unidirectional axial movement.

16. The method of claim 15 further comprising:

providing a fluid conduit coupled between said interior, said exterior, and said actuator;

providing a check valve in said conduit between said exterior at a first port and said interior and said actuator at a second port; and pressurizing said interior with respect to said exterior so as to shut said check valve and allow pressurization of said actuator.

* * * * *